United States Patent [19]

Jost

[11] 4,138,762

[45] Feb. 13, 1979

[54] APPARATUS FOR SUCKING UP DRY OR WET POLLUTANTS FROM THE FLOOR OR GROUND

[76] Inventor: Theodor Jost, Zum Kleeblatt, Stein Am Rhein, Switzerland

[21] Appl. No.: 698,740

[22] Filed: Jun. 22, 1976

[30] Foreign Application Priority Data

Jul. 5, 1975 [DE] Fed. Rep. of Germany ..... 2530126

[51] Int. Cl.[2] ..... A47L 9/02

[52] U.S. Cl. ..... 15/419

[58] Field of Search ..... 15/354, 359, 415, 418, 15/419, 420, 375, 421

[56] References Cited

U.S. PATENT DOCUMENTS

| | | | |
|---|---|---|---|
| 1,800,316 | 4/1931 | Replogle | 15/375 X |
| 2,157,077 | 5/1939 | Kroenlein | 15/419 X |
| 2,517,058 | 8/1950 | Uber | 15/375 X |
| 3,201,819 | 8/1965 | Wilgus | 15/349 |

FOREIGN PATENT DOCUMENTS

| | | | |
|---|---|---|---|
| 926968 | 5/1963 | United Kingdom | 15/415 |

*Primary Examiner*—Christopher K. Moore

[57] ABSTRACT

Vacuum apparatus for sucking up pollutants with a suction mouthpiece maintained at a given distance above the ground. The mouthpiece is partially defined at least on one side by rollers guided loosely on the apparatus and held in place during operation by the vacuum created in the apparatus. The rollers enable the apparatus to operate effectively over rough ground and to pick up relatively large pollutants.

9 Claims, 14 Drawing Figures

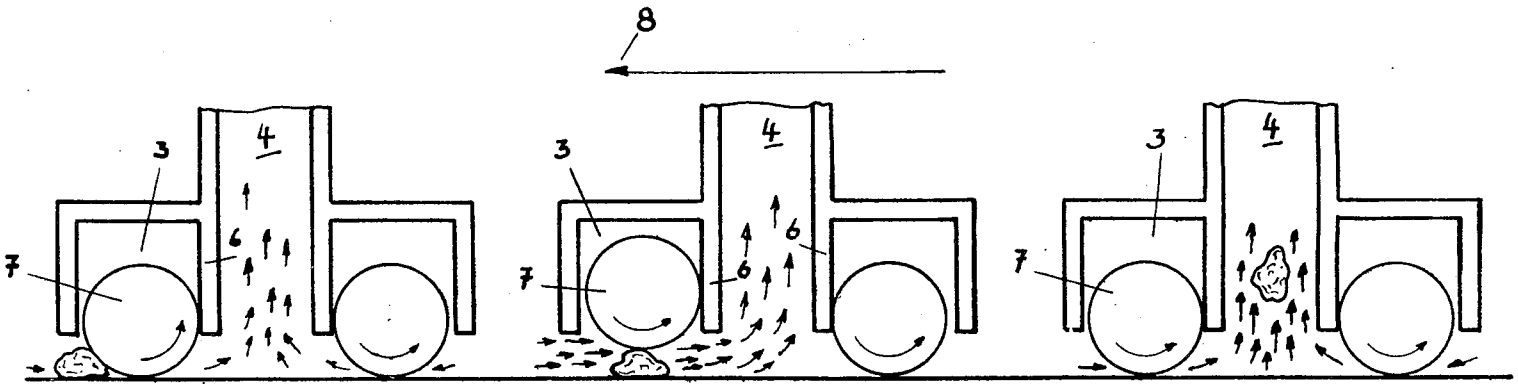
Fig. 9
Fig. 10
Fig. 11
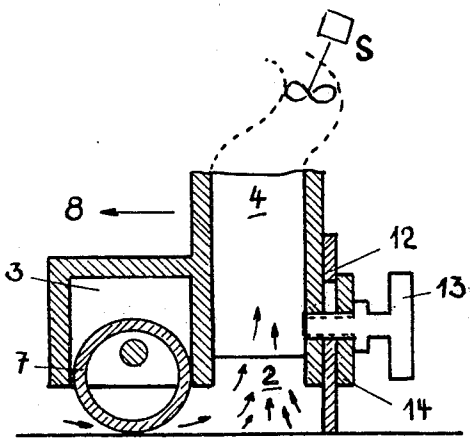
Fig. 12
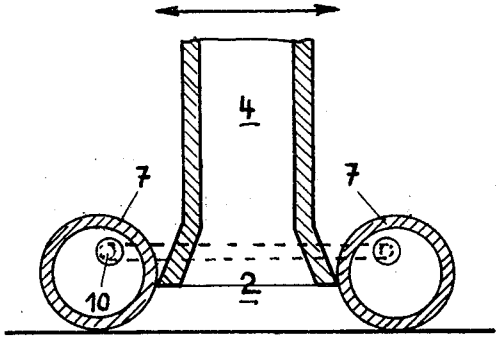
Fig. 13
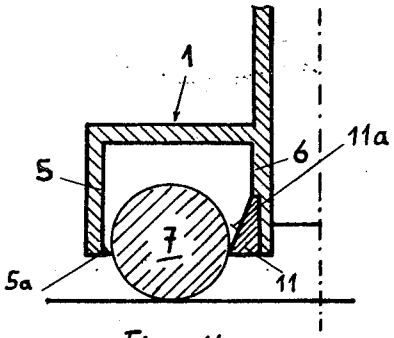
Fig. 14

APPARATUS FOR SUCKING UP DRY OR WET POLLUTANTS FROM THE FLOOR OR GROUND

FIELD OF THE INVENTION

The present invention relates generally to vacuum machines and more particularly to an apparatus for sucking up dry or wet pollutants from the floor or ground with a suction mouthpiece held at a given distance above the ground, a suction channel leading to a suction fan and at least on one side rollers guided loosely in or on the apparatus by this suction mouthpiece.

DISCUSSION OF THE PRIOR ART

The hitherto known suction apparatuses generally have a suction nozzle provided with interchangeable rubber lips on the mouthpiece in order to adapt the air gap between the floor and suction nozzle to the characteristics of the particular floor surface and to the material being sucked up, especially in the case of large dust exhausters such as industrial dust exhausters. In many cases an optimum setting is not possible because in the case of a small air passage through the rubber lips all coarser pollutants are pushed away. However, if the air gap is set too large the suction action will be greatly reduced or, as in the case of street cleansing machines which merely have a suction mouthpiece which widens in funnel-like manner, must be compensated by a corresponding powerful suction fan.

Street cleansing machines of the type indicated hereinbefore are already known. In these the suction fan does not serve to suck up the actual pollutants because these are generally taken up by means of one or more rotary brushes which force the pollutants into the garbage container on the machine. The suction fan serves solely to suck up dust which is whirled up during the action of the brushes. It must have a relatively weak suction action to ensure that it does not suck up the pollutants brought together by the brushes and which would only block the suction fan. However, as a result of the weak suction action there is a danger that part of the whirled up dust is no longer reached by the suction fan and drops from the street cleansing machine. To prevent this the brush, or when there are several brushes at least the main brush, is bounded by rollers arranged in front of or behind the same in the travelling direction, as well as by a casing portion which laterally extends almost down to ground level. Thus, the rollers only serve as a type of rolling dust curtain which together with the casing portion localizes dust spreading.

Suction apparatuses are also known where rollers are arranged in front of and/or behind the suction mouthpiece in both travelling directions of the apparatus. However, these rollers are bearing members, that is, they are not loosely guided in the apparatus and instead the latter is supported on the rollers. This rigid guidance of the rollers results in the entire apparatus being raised by unevennesses on the ground or floor so that between the latter and the rollers and substantially over the entire length thereof an opening for the air is formed which is too large. As a result the flow-rate in front of the mouthpiece opening and consequently the suction action are reduced which has to be compensated again by costly complicated measures.

SUMMARY OF THE INVENTION

An object of this invention is to obviate the aforementioned disadvantages and to provide an apparatus for sucking up pollutants of all types such as small stones, sand, dust, dirt and/or moisture from a floor or ground which permits an approximately constantly high flow-rate of the air sucked into the apparatus, even in the case of ground unevenness, resulting in a high cleansing action.

According to the invention, this problem is solved in that the rollers arranged in or on the guidance member can be engaged with the outside of the latter by the vacuum in the suction channel and in the mouthpiece so as to form a continuation of the mouthpiece which reduces the cross-section of the mouthpiece suction area for the purpose of increasing the flow-rate.

BRIEF DESCRIPTION OF THE DRAWING

The objects, advantages and features of the present invention will be apparent from the following detailed description when read in conjunction with the accompanying drawings in which:

FIGS. 9 to 11 schematically depict the operation of the present apparatus; and FIGS. 12 to 14 show schematic views of various additional embodiments of the apparatus.

DETAILED DESCRIPTION OF THE PREFERRED EMBODIMENTS

Figure 1:
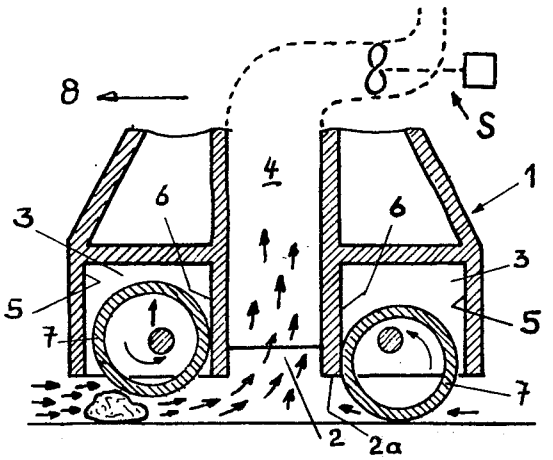
FIG. 1 shows a first embodiment of the apparatus in section parallel to its direction of movement.

According to a preferred embodiment as shown in FIG. 1, the apparatus has a plastic or metal casing 1 which is constructed in such a way that a mouthpiece 2 is formed which is bounded on each side by a case 3. To the mouthpiece 2 is connected a suction channel 4 which is also formed by the casing 1 and said suction channel leads to a schematically represented vacuum source S, normally a suction fan. The suction fan S can be quite independent of the apparatus because it serves, for example, to replace the conventional suction part in large industrial dust exhausters. However, the apparatus can also be autonomous, in which case the suction fan and further accessories, particularly the dust bag, can be provided specifically for the apparatus to which they are connected.

Figure 4:
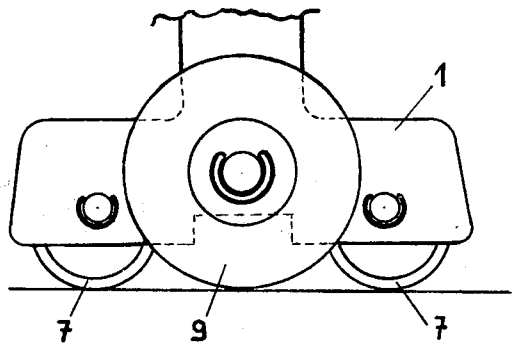
FIG. 4 is a side view of another embodiment of the invention.
Figure 5:
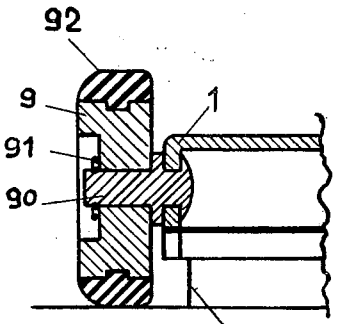
FIG. 5 is an axial sectional view of the embodiment of FIG. 4.

Each cage 3 is open at the bottom and preferably has an approximately rectangular cross-section with downwardly projecting side plates 5 and 6. At least one roller 7 is loosely mounted in each cage and the external diameter of the roller is somewhat less than the distance between the inner surfaces of the two side plates 5 and 6. In this connection "loosely mounted" means that the roller can move radially within a defined area. When the apparatus is moved in the direction of arrow 8, each roller is only guided by side plates 5 and 6 and normally rolls along the floor or ground. It should be noted that the rollers 7 have no bearing or supporting function. The distance of casing 1 from the floor is either determined by the chassis of the dust exhauster on which the apparatus is mounted or by special runners (wheels) 9 (FIGS. 4 and 5) or slides. As shown in FIG. 5, each runner is mounted on a shaft 90 fixed to casing 1 and is prevented from falling out by a snap ring 91. To permit travel with maximum quietness it is covered with a tread ring 92 which is preferably made from rubber.

If the suction fan S is now switched on a powerful vacuum is formed in suction channel 4 and at the opening 2*a* of suction mouthpiece 2. This draws the loosely running rollers 7 against the inner side plates 6 of the cage and this also applies to the rear rollers in the travelling direction which would normally move away from side plate 6 when rolling. Due to the two-sided engagement of the rollers on the side plates bounding suction channel 4 and mouthpiece 2, the mouthpiece is effectively extended down to the floor or ground. The suction cross-section between the floor and opening 2*a* is in this way effectively reduced and consequently the air speed is considerably increased. As the apparatus is more particularly intended for uneven floors as well as for carpets, when such unevenness occurs or even between the carpet fibres the air flows at high speed into the space between the front and rear rollers in order to replace the air sucked up by the suction fan S. This after-flow of air leads to an intense suction action which can be so large that even larger pollutants beyond the reach of the apparatus can be held or even drawn against the front rollers before the said rollers pass over the same.

It is to be noted that no air can flow over the tops of rollers 7 because the rollers engaging with side plate 6 prevent any such secondary flow which would only impair the suction action. As a result of the suction or wake the rollers are not only pressed against side plate 6 but also against the floor to be cleaned so that for this reason alone the suction cross-section between the rollers and floors is always regulated to a minimum.

The air gap between the opening or lips 2*a* of suction mouthpiece 2 and the floor to be cleaned is therefore at least partly limited on two sides (left and right in FIG. 1) by the rollers 7. Exceptions to this are only formed by the longitudinal spacings between the individual rollers of a cage 3, the gaps between a single or several rollers on the one hand and the floor on the other formed when the particular roller or rollers pass over a relatively large pollutant (inclined roller in FIG. 2) and naturally the two terminal cross-sections at right angles to the direction of travel. Each terminal cross-section is limited by the rollers on both sides of the mouthpiece 2 by the said mouthpiece itself and by the floor (lateral inflow of air).

Figure 7:
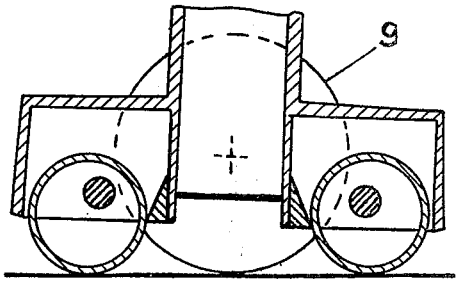
FIGS. 7 and 8 show an embodiment similar to FIG. 4 partly in section and in operation.
Figure 8:
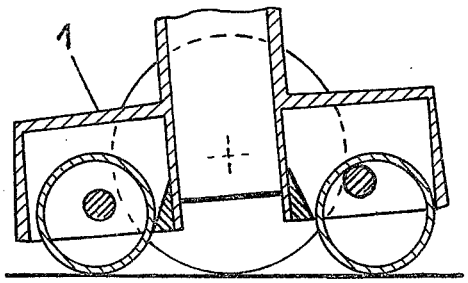

Due to the loose guidance of rollers 7 the limiting of the air gap remains unchanged even when the casing is inclined as shown in FIGS. 7 and 8. The changes in the position of casing 1 relative to the floor can best be carried out with runners 9 so that a thus equipped apparatus is best suited to be guided manually by a suitable handle (not shown).

In order to prevent the rollers 7 from falling out of the cage when the apparatus is lifted in each case one bar 10 is passed through the hollow inside of the corresponding roller fixed in removable manner to the cage wall perpendicular to the image plane. Thus, on lifting the apparatus the rollers are suspended on these bars, whereby the latter can be removed in order to remove the rollers 7 from cages 3.

Figure 2:
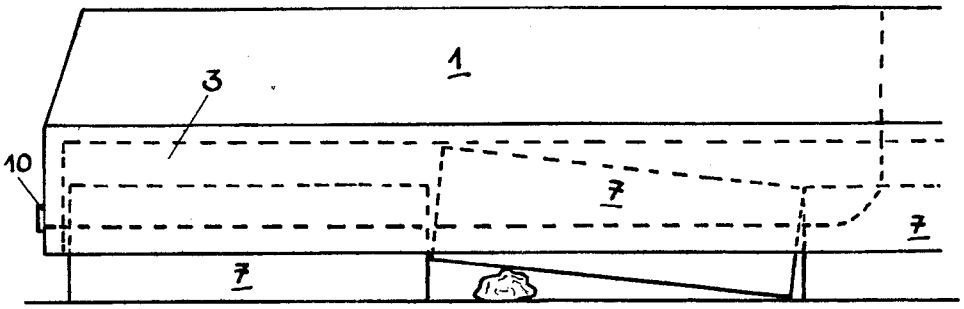
FIG. 2 is the embodiment of FIG. 1 in a view at right angles to the direction of movement.

In the description up to now reference has only been made to a single roller per cage. However, preferably each cage contains several rollers 7 which in the case of a flat floor roll over the latter coaxially to one another, whereby the bar 10 passes through all the rollers. If, as shown in FIG. 2, one of the rollers strikes an unevenness, it can be raised independently of the others so that briefly a somewhat larger air passage cross-section is formed which closes again immediately upon passing over the obstacle. The length of the rollers is random within certain limits. However, it is recommended neither to use too long nor too short rollers which are rings rather than rollers because in the latter case too many air gaps would form which disturb an orderly flow to the mouthpiece. For the same reason it is advantageous to place more rollers in one cage 3 then in the other, whereby naturally the length of the rollers also varies. This prevents the gap between the rollers from exactly facing one another which could also have a disadvantageous influence on the flow.

Figure 3:
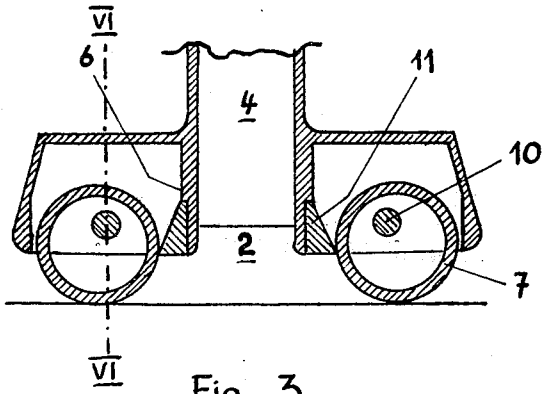
FIG. 3 shows a second embodiment of the apparatus in the same section as in FIG. 1.

FIG. 3 shows a slightly modified embodiment of the apparatus. The modification comprises placing an abrasion-proof insert 11 on each of the outsides of suction mouthpiece 2, that is within cages 3 near the lower ends of plates 6. This pair of inserts 11 is sufficient. No such insert is necessary on the opposite side plates 5 of the cage because due to the powerful suction action the rollers are always engaged against side plates 6. This includes the rear rollers as can be gathered particularly clearly from FIGS. 9 to 11 which illustrate the operation of the apparatus. As can be seen, when the apparatus during its movement strikes against larger particles (FIG. 9) they are normally no longer pushed away as is the case with the known suction nozzles which have rubber lips. Instead the roller 7 (or one of the rollers with reference FIG. 2) rolls over the obstacle (FIG. 10) whereby the roller is pressed somewhat more deeply into cage 3. Furthermore, according to FIG. 2 it will also generally tilt with respect to horizontal. Due to this raising action a larger air passage cross-section is temporarily formed which, however, if the suction fan and suction channel 4 are correctly dimensioned, is still too small to cause a serious drop in the flow rate in the area of mouthpiece 2. The strong air flow carries with it not only small particles but when the larger particles have been released by the roller rolling over them, also the said larger particles (FIG. 11). Then all the rollers are located on the floor again.

Figure 6:
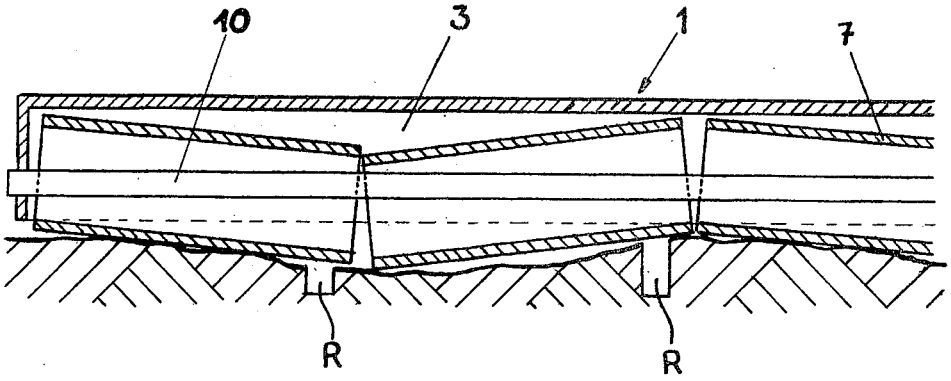
FIG. 6 is a sectional view taken along the line VI—VI of FIG. 3 with the apparatus travelling on very uneven ground.

As already stated, no air can be sucked over the top of the rollers. Thus, the air must flow through the already mentioned gaps and spaces in the apparatus. As shown in FIG. 6, these can also be spaces formed between individual rollers and the uneven ground, whereby grooves R in the floor also form such spaces. As can be seen in FIG. 2, here again each roller can within certain limits move relative to the others. In the case of rough or uneven ground strong air flows occur on the bottom of the rollers which result in a corresponding cleansing action, whereby these air flows are parallel to the direction of movement. When the ground is smooth and flat without any depressions, there are no such air flows so that the air can only flow in from the side which in certain circumstances can lead to too small a passage cross-section and therefore to considerable suction noise. In the case of a smooth ground surface of this type such as occurs at airports, the apparatus can however be raised to such an extent that at least the front rollers in the direction of travel are raised somewhat from the ground and are only suspended on bar 10. However, even in this case the rollers are not superfluous because when they encounter material to be sucked up which is higher than the distance between these rollers and the ground, they individually are raised and roll over the material so that the latter is not pushed away but instead comes into the area of suction mouthpiece 2. The raising and therefore the setting of a given distance between rollers and ground can, in the case of travelling cleansing machines, be set, for example, from the driver's seat.

Due to the sliding friction of the rollers 7 on side plates 6 there is also a self-cleaning action which ensures that the rollers always remain clean. It is only in the case of particularly strongly adhering, for example sticky, pollutants that these may have to be removed manually after using the apparatus.

FIG. 12 shows a somewhat simpler embodiment which is especially suitable when the apparatus only has to be moved in one direction, for example when fitted on a travelling cleansing machine. The direction of movement is again indicated by arrow 8. In this embodiment only a single cage 3 with one or more rollers 7 is provided. On the other side of the suction mouthpiece 2 is provided a rubber lip 12 which is, for example, pressed strongly against the wall of mouthpiece 2 by a wing nut 13 or the like and a plate 14. With the nut loosened the rubber lip can be set to the correct spacing from the ground. The front rollers function in the manner shown in FIGS. 9 to 11. Even material with large dimensions is sucked up by the suction fan before the rubber lip 12 reaches it.

The engagement of rollers 7 on side plates 6 on mouthpiece 2 makes it possible to partly or even completely, as in FIG. 13, eliminate the cage if there is a sufficiently large suction pressure. In the latter case the rollers of each row are only loosely connected with the suction mouthpiece or the suction channel 4 by the particular bar 10. When the suction fan is switched on they engage with the mouthpiece 2 whereby on the latter they slidingly roll on the ground.

The insert 11 shown in FIG. 3 can also be used for the loose guidance of rollers 7 when it is ensured that the distance from its edge 11*a* engaging with the roller to the opposite side plate 5 is smaller than the diameter of the roller or rollers (FIG. 14). On raising the apparatus the latter cannot fall from the cage. They are assembled by a lateral insertion into the cage (perpendicular to the image plane) whereby the cage must have a corresponding assembly opening which can be closed again after insertion has taken place. As bar 10 is unnecessary, rollers with a solid cross-section can be used here. However, in this case the height of the suction mouthpiece 2 above the ground or floor, the roller diameter, as well as the above-mentioned distance must be more accurately matched to one another than in the other embodiments. For this purpose side plate 5 can be provided with a projecting edge 5*a* which together with the edge 11*a* of insert 11 (or a corresponding construction of side plate 6) fixes the said spacing in such a way that it is smaller than the roller diameter by the desired amount.

The invention is not limited to the embodiments described and represented hereinbefore and various modifications may occur to those skilled in the art which are within the scope of the invention.

What is claimed is:

1. Movable apparatus for sucking up both dry and wet pollutants from the floor or ground, said apparatus comprising:

a casing;

a mouthpiece in said casing, said mouthpiece being partially defined by a first plate on at least one side thereof, one edge of said first plate forming a first lip normally maintained at a predetermined distance above and substantially parallel to the ground;

means adapted for collecting the pollutants;

a suction channel leading from said mouthpiece to said collecting means;

means for creating the necessary vacuum in said suction channel;

a first guidance member mounted to said casing parallel with said first plate outside said mouthpiece; and movable sealing means comprising at least one first roller normally loosely coupled to said casing for radial and rotational movement with respect thereto, said first roller being maintained generally parallel to and normally rolling along the ground with movement of said apparatus, said first roller being retained coupled to said casing outside said mouthpiece by means of said first guidance member;

whereby said first roller is slidingly held against said first plate at the side of said first lip away from said suction channel outside said mouthpiece by means of the vacuum created by said vacuum means, said first roller thereby effectively extending said mouthpiece from said first lip to the ground.

2. The apparatus recited in claim 1 wherein said movable sealing means comprises a plurality of first rollers in end-to-end coaxial relationship.

3. The apparatus recited in claim 1 wherein said mouthpiece is further partially defined by a second plate on the other side thereof, one edge of said second plate forming a second lip normally maintained at a predetermined distance above and substantially parallel to the ground, said apparatus further comprising:

a second guidance member mounted to said casing parallel with said second plate and outside said mouthpiece; and said movable sealing means further comprising at least one second roller loosely coupled to said casing for radial and rotational movement with respect thereto, said second roller being maintained generally parallel to and normally rolling along the ground with movement of said apparatus, said second roller being retained coupled to said casing outside said mouthpiece by means of said second guidance member;

whereby said second roller is slidingly held against said second plate at the side of said second lip away from said suction channel outside said mouthpiece by means of the vacuum created by said vacuum means, said second roller thereby effectively extending said mouthpiece from said second lip to the ground.

4. The apparatus recited in claim 3 wherein said movable sealing means further comprises a plurality of first and second rollers, said plurality of first rollers being in end-to-end coaxial relationship, said plurality of second rollers being in end-to-end coaxial relationship.

5. The apparatus recited in claim 1 wherein said first guidance member comprises a bar mounted outside said mouthpiece and passing through said first roller and wherein said first roller is a hollow cylinder.

6. Movable apparatus for sucking up both dry and wet pollutants from the ground, said apparatus comprising:

a casing;

an elongated mouthpiece formed in said casing, said mouthpiece being partially defined at its forward side by a first plate, one edge of said first plate forming a first lip normally maintained at a predetermined distance above and substantially parallel to the ground;

means adapted for collecting the pollutants;

a suction channel leading from said mouthpiece to said collecting means;

means creating the necessary vacuum in said suction channel;

movable sealing means comprising a plurality of first rollers; and a first guidance member on the forward side of said apparatus forming a forward cage comprising:

said first plate of said mouthpiece forming one side of said cage;

a forward plate mounted to said casing and spaced from said first plate forming the other side of said cage; and means for retaining said first rollers normally loosely mounted for radial and rotational movement in end-to-end relationship within said forward cage outside said mouthpiece partially between said first and forward plates and extending partially below said first lip:

said plurality of first rollers normally extending downward from said forward cage to the ground and being held slidingly against said first plate by means of the vacuum created by said vacuum means thereby effectively extending the forward side of said mouthpiece from said first lip to the ground.

7. The apparatus recited in claim 6 wherein said first guidance member further comprises a first bar mounted within said first cage substantially parallel with said lip and passing through said first rollers thereby preventing them from being separated from said apparatus when said apparatus is lifted.

8. The apparatus recited in claim 6 wherein said movable sealing means further comprises a plurality of second rollers, said apparatus further comprising:

a second guidance member on the rearward side of said apparatus forming a rearward cage comprising:

a second plate partially defining said mouthpiece at its rearward side, one edge of said second plate forming a second lip normally maintained at a predetermined distance above and substantially parallel to the ground;

a rearward plate mounted to said casing and spaced from said second plate formed the other side of said rearward cage; and means for retaining said second rollers normally loosely mounted for radial and rotational movement in end-to-end relationship within said rearward cage outside said mouthpiece partially between said second and rearward plates and extending partially below said second lip;

said plurality of second rollers normally extending downward from said rearward cage to the ground and being held slidingly against said second plate by means of the vacuum created by said vacuum means thereby effectively extending the rearward side of said mouthpiece from said second lip to the ground.

9. The apparatus recited in claim 8 wherein said second guidance member further comprises a second bar mounted within said second cage substantially parallel with said second lip and passing through said second rollers thereby preventing them from being separated from said apparatus when said apparatus is lifted.

* * * * *